US007400486B2

(12) United States Patent
Stewart

(10) Patent No.: US 7,400,486 B2
(45) Date of Patent: Jul. 15, 2008

(54) GROUNDING DEVICE FOR AUTOMATED GUIDED VEHICLES

(75) Inventor: Brian G. Stewart, Beverly Hills, MI (US)

(73) Assignee: Jervis B. Webb Company, Farmington Hills, MI (US)

( * ) Notice: Subject to any disclaimer, the term of this patent is extended or adjusted under 35 U.S.C. 154(b) by 0 days.

(21) Appl. No.: 11/595,583

(22) Filed: Nov. 10, 2006

(65) Prior Publication Data

US 2008/0112104 A1 May 15, 2008

(51) Int. Cl.
*H05F 3/02* (2006.01)

(52) U.S. Cl. ..... 361/219

(58) Field of Classification Search ..... 439/504; 361/212–220

See application file for complete search history.

(56) References Cited

U.S. PATENT DOCUMENTS 2,184,811 A * 12/1939 McDonald et al. ..... 361/216
2,327,029 A * 8/1943 Donelson et al. ..... 361/216
2,378,623 A * 6/1945 Donelson et al. ..... 361/216
2,413,610 A * 12/1946 Donelson ..... 361/216
2,753,491 A * 7/1956 Legge ..... 361/219
2,786,161 A * 3/1957 Lunden ..... 361/216
2,851,639 A * 9/1958 Ford et al. ..... 361/216
3,750,833 A 8/1973 Kahl
4,321,653 A * 3/1982 Takahashi ..... 361/219
5,367,243 A * 11/1994 Wells et al. ..... 320/105
5,812,267 A 9/1998 Everett, Jr. et al.
6,327,131 B1 * 12/2001 Thomas et al. ..... 361/212
6,543,591 B2 4/2003 Kuzuya

OTHER PUBLICATIONS

ESD Association Technical Report, "Measurement and ESD Control Issues for Automated Equipment Handling of ESD Sensitive Devices below 100 Volts", ESD TR10.0-01-02 (TR14-02), 2002, Rome, NY (11 pages).

ESD Association, "ESD Association Standard Practice for Protection of Electrostatic Discharge Susceptible Items—Automated Handling Equipment (AHE)", ESD SP10.1-2000, Feb. 6, 2000, Rome, NY (16 pages).

* cited by examiner

*Primary Examiner*—Neil Abrams
(74) *Attorney, Agent, or Firm*—Dickinson Wright PLLC

(57) ABSTRACT

A device and method is provided for use in connection with electrically grounding an automated guided vehicle. A grounding strap is suspended from the automated vehicle for contacting an electrical conductive ground device mounted to a floor along a travel path of the automated guided vehicle. In operation, the grounding strap contacts the electrically conductive ground device to electrically ground electronics used in connection with the guided vehicle.

10 Claims, 5 Drawing Sheets

GROUNDING DEVICE FOR AUTOMATED GUIDED VEHICLES

BACKGROUND OF THE INVENTION

The present invention relates to a grounding device for automated guided vehicles adapted to traverse a path on a floor surface coated with a non-conductive material to thereby deliver items in an automated fashion to a set location and a method therefore. More specifically, the invention is concerned with electrically grounding an automated vehicle to a ground in order to prevent an electric charge from building up in said automated guided vehicle including, for example, static electricity, thereby damaging electronic devices or persons associated with said guided vehicle. The invention involves the use of a grounding strap extending from said guided vehicle and adapted for contacting a ground device electrically grounded to the earth.

Automated guided vehicles have become common in many industrial applications. These vehicles are used to transport material along a predetermined guide path established at an industrial facility. These automated guided vehicles utilize various methods to guide the vehicle in an automated manner. Most all of these various guidance methods include the use of electronics positioned on the guided vehicle. In addition, in some cases, the guided vehicles also include electric motors to both power the vehicle and perform functions at various locations in the facility.

Electrostatic build-up of an electrical charge is well known in the facility management and material handling industries. If not managed appropriately, electrostatic build-up can harm electronics used in a facility as well as personnel working in such facility. Prior art grounding devices including metal chains, flexible conductive strips and conductive surface coatings. Metal chains are known to be mounted to the frame of vehicles for contact with the surface having no coatings such as a cement surface with no coatings. Such chains are known to be subject to breaking, bouncing and creating hazardous sparks. U.S. Pat. No. 4,321,653 shows a flexible conductive strip mounted to a frame of an automobile for contacting the ground. These prior art devices were designed for use with a conductive surface, most commonly the ground, and not for use on a surface coated with a non-conductive material.

Conductive coatings are relatively newer in the industry and are known to assist in grounding facility equipment to protect workers and equipment. In applications where the use a guided vehicle is planned, most facility floor surfaces are coated with such conductive coatings thereby permitting the guided vehicle to be electrically grounded through the vehicle tires to the conductive coating. However, due to the increasing use of automated guided vehicles, many facilities are installing such guided vehicles without having a conductive coating on the facility floor surface, and in most cases, a non-conductive coating remains. Under such circumstances where the facility floor does not have a conductive coating, this can affect the ability to ground facility machinery and equipment thereby causing a serious electrostatic build-up hazard.

SUMMARY OF THE INVENTION

A device for electrically grounding an automated guided vehicle includes a grounding strap suspended from the automated guided vehicle and adapted for contacting at least one ground device to thereby electrically ground the guided vehicle. The guided vehicle includes a power source for providing power to on-board electronics on the guided vehicle and the power source is grounded with a ground wire to the grounding strap.

The present invention also includes a method for electrically grounding an automated guided vehicle for use on a non-conductive surface. The steps of the method include mounting an electrically conductive grounding strap to the automated guided vehicle, connecting a negative wire of a power source of the automated guided vehicle to the ground strap, mounting an electrically conductive ground device to a surface to be traversed by the automated guided vehicle; and positioning the grounding strap to be in contact with the ground device when the automated guided vehicle traverses the surface.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
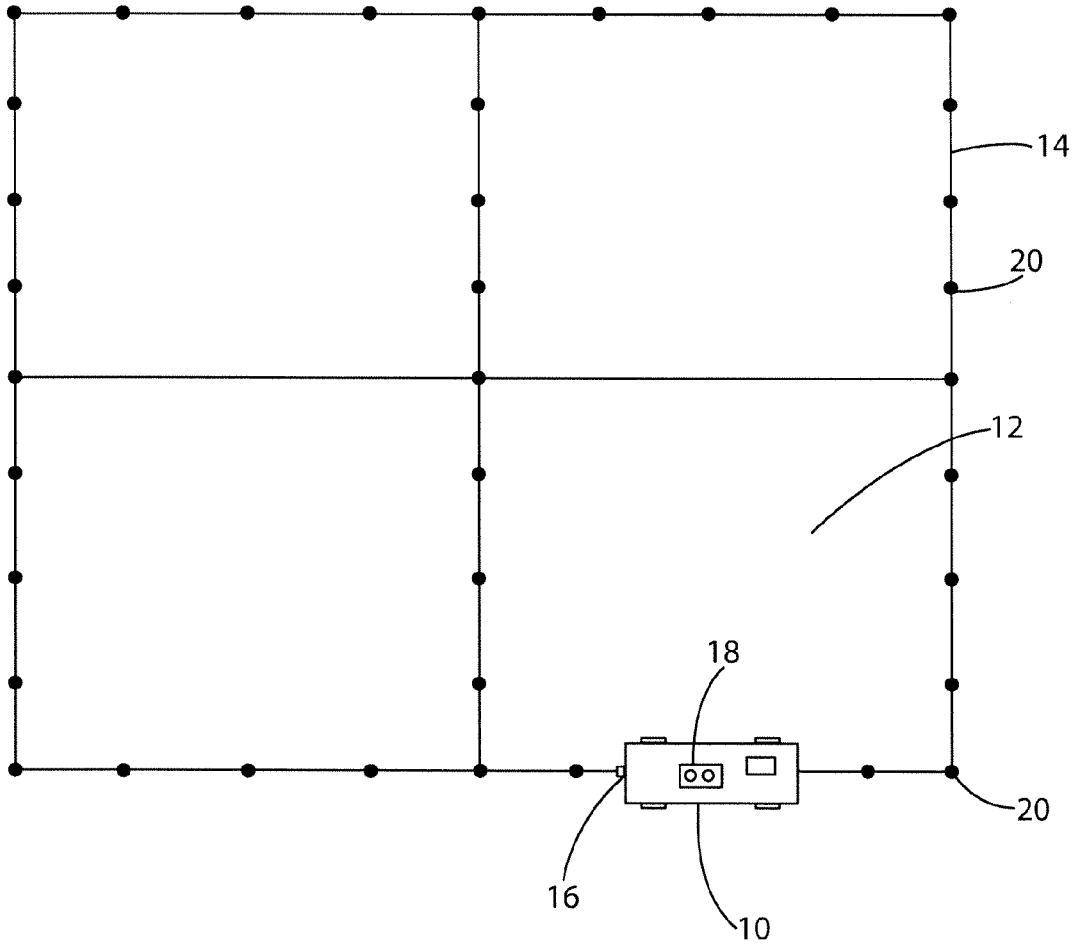
FIG. 1 is a plan view of a surface having a path to be followed by an automated guided vehicle.

FIG. 1 shows a plan view of an automated guided vehicle 10 traversing a floor 12 along a predetermined path 14. The guided vehicle 10 includes a grounding strap 16 suspended from the guided vehicle 10 and a power source 18 positioned on the guided vehicle 10 for providing power to electronics located on the vehicle 10. FIG. 1 shows the floor surface including a plurality of ground devices 20 mounted to the floor 12.

Figure 2:
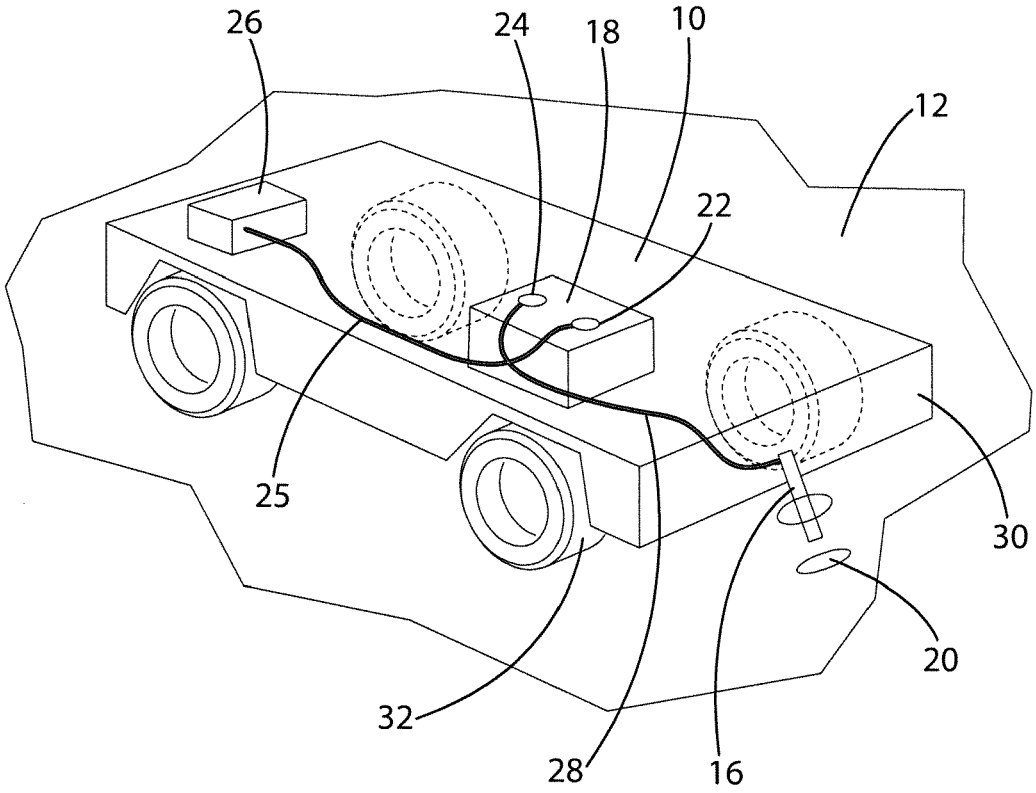
FIG. 2 is a perspective view showing an automated guided vehicle on a non-conductive surface.

FIG. 2 shows the guided vehicle 10 having a frame 30, tires 32, power source 18 and the grounding strap 16. The power source 18 includes a positive terminal 22 and a negative terminal 24. The positive terminal 22 transmits current through a wire harness 25 to electronics 26, mounted on the guided vehicle 10, including, for example, an electric motor or on-board computers. The negative terminal 24 includes a ground wire 28 connecting between the negative terminal 24 and the grounding strap 16. By connecting the negative terminal 24 directly with the grounding strap 16 it has been found that all potential differences, developed by the electronics 26, can be reduced by grounding directly to the ground device 20 through the grounding strap 16. It should be appreciated that in some applications where the risks associated with multiple electrical potential differences is lower, it may be possible to connect the negative terminal 24 to the frame 30 of the vehicle 10 instead of directly to the grounding strap 16.

Figure 3:
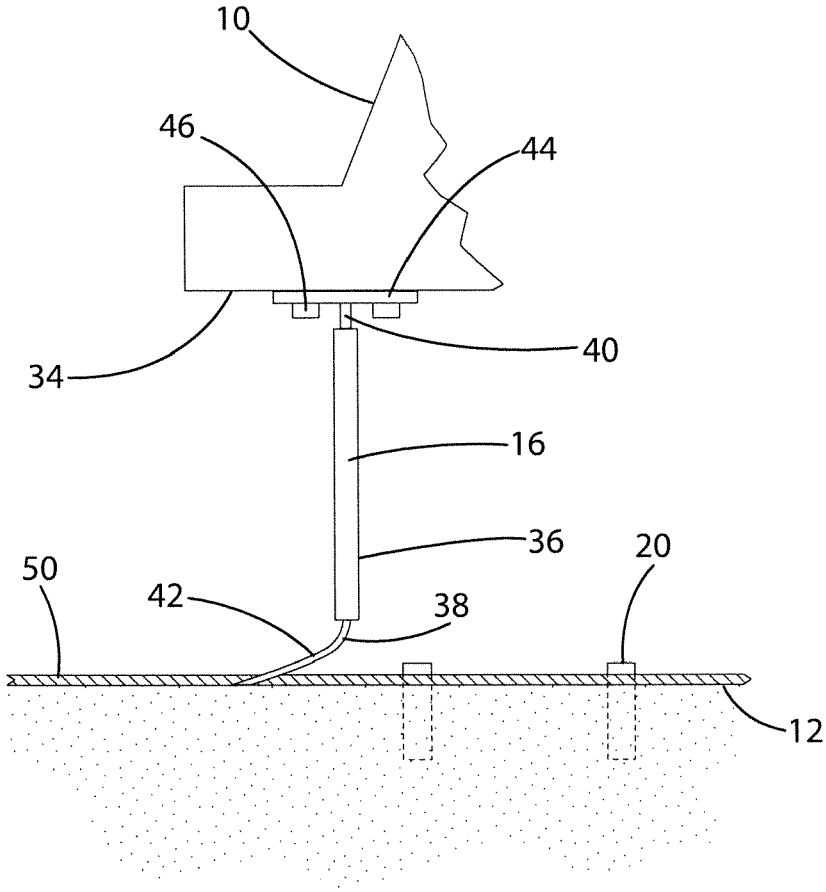
FIG. 3 is a partial side view of the present invention.

FIG. 3 shows a portion of the guided vehicle 10 having the grounding strap 16 suspended from a trailing edge 34 of the vehicle 10. In this example, the grounding strap 16 is made of a composite housing 36 enclosing a conductive metal strip 38. The conductive metal strip 38 extends out from one both ends of the housing 36 on one end 40 for attachment to the vehicle 10 and a second end 42 for contacting the ground devices 20 mounted to the floor 12. In this embodiment the grounding strap 16 is attached to the trailing edge 34 of the vehicle 10 with the use of a bracket 44 and fasteners 46, other methods may exist for attaching the strap 16 to the vehicle 10 such as, for example, by welding. In addition, it should be appreciated that the grounding strap 16 may be mounted to other portions of the vehicle 10 and not only the trailing edge 34.

FIG. 3 shows the ground devices 20 embedded into the floor 12 having a non-conductive surface coating 50 applied to the floor 12. In this example, the ground devices are shown as conductive rods 20 spaced a predetermined distance from one another. The predetermined distance is based on a calculation considering certain factors such as the length of the path 14 and the amount of electricity used on the guided vehicle 10. It has been found that the ground devices 20 can be fixedly positioned into holes drilled into the floor 12 a sufficient depth below the non-conductive surface coating 50 permitting the ground devices to be ground to the earth.

Figure 4:
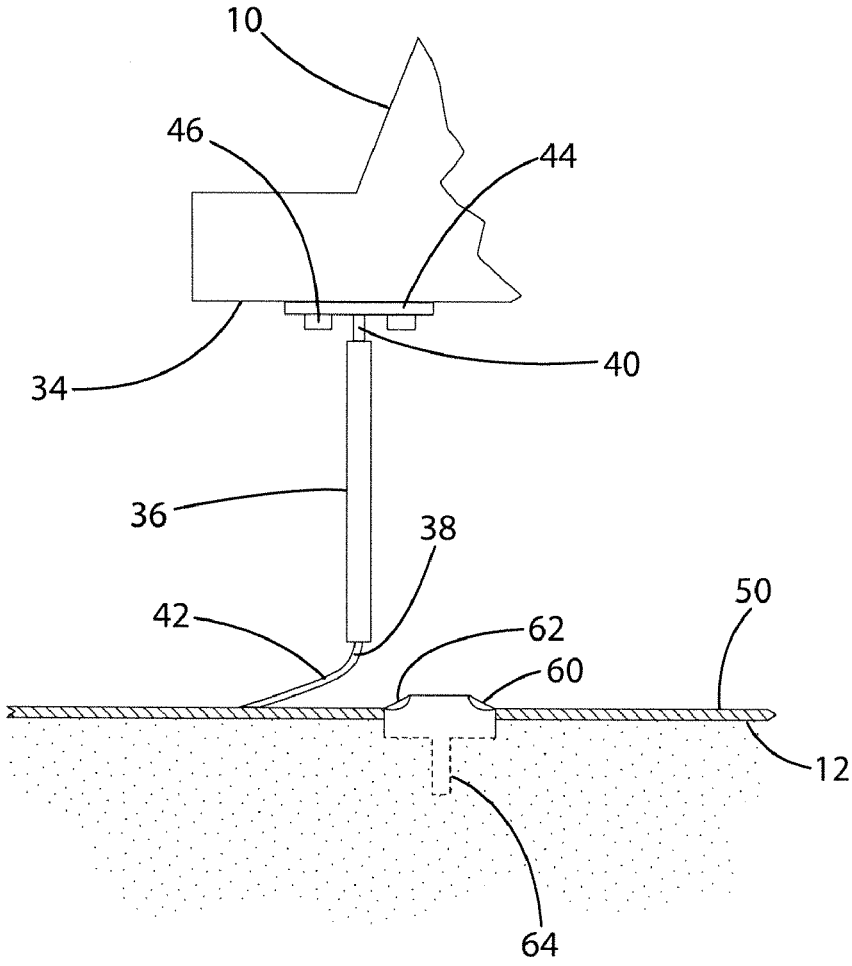
FIG. 4 is a partial side view of another embodiment of the present invention.

FIG. 4 shows the ground devices 20 designed as stations 60 also spaced a predetermined distance from one another. In this example, the ground devices 20 designed as stations 60 having a low profile to permit ease of walking on the floor 12 and including reflectors 62 to improve the visibility of the stations 60 to persons walking on the floor 12. It has been found that the stations 60 can be fixedly positioned into holes drilled into the floor 12 a sufficient depth below the non-conductive surface coating 50 permitting the ground devices to be ground to the earth. In this embodiment, the stations 60 include a stake portion 64 for insertion into such holes.

Figure 5:
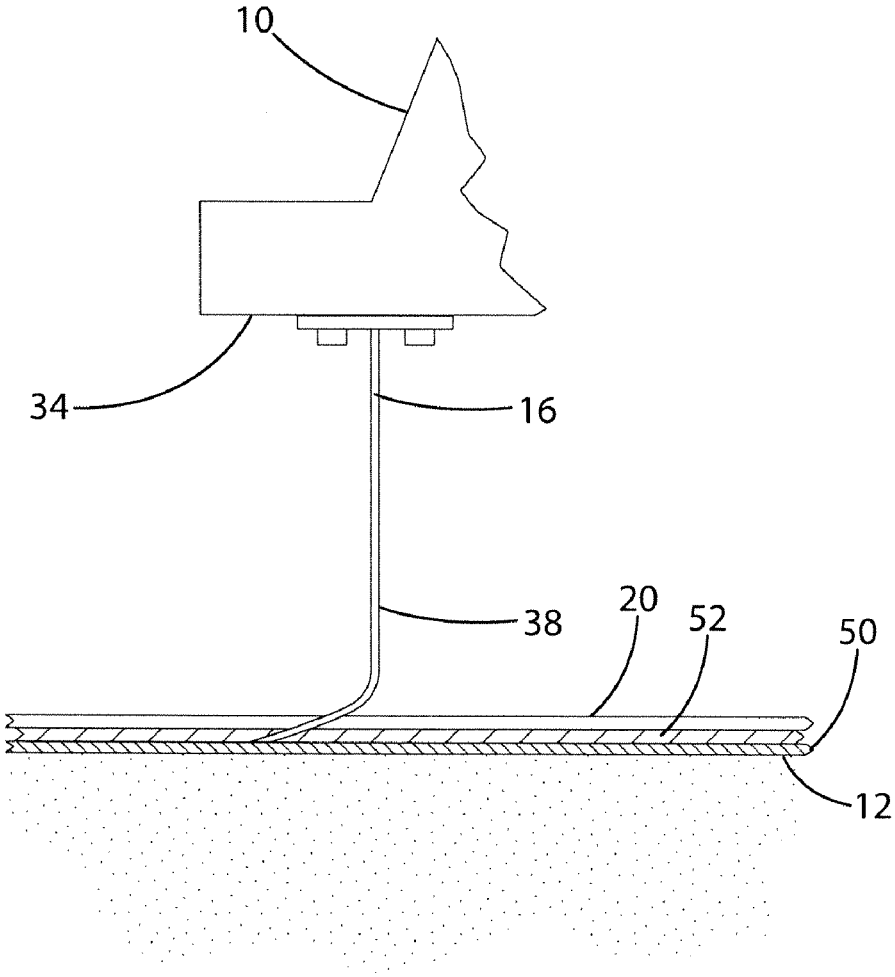
FIG. 5 is a perspective view of another embodiment of the present invention.

FIG. 5 shows another example of the present invention wherein the ground device is designed as a rail 20 mounted to the floor 12. The rail may be mounted to the floor 12 in many different ways provided each is with a sufficient depth below the nonconductive surface coating 50 permitting the rail 20 to ground to the earth. In this example, the rail 20 is shown with supports 52 spaced from the surface 50. The grounding strap 16 is suspended from the vehicle 10 a sufficient distance to permit the grounding strap 16 to be in contact with the rail 20 throughout the entire distance of the path 14 since the rail 20 is constructed in a manner to follow the path 14. In this example, the grounding strap 16 is shown without a housing surrounding the conductive strip 38. It should be appreciated that the rail 20 may extend along the entire path 14 or along only a portion of the path 14.

The present invention is provided for use with non-conductive floors 12 including, for example, in cases where flooring surfaces have a non-conductive coating applied thereto. Since the coating is a non-conductive coating, the coating inhibits the ability of the vehicle, through the tires 32, to electrically ground to the earth. If the vehicle is not ground to the earth, electrical build up may occur and cause a significant accident either to persons or the electronics used with the vehicle. In use with non-conductive coated floors, the grounding strap 16 is mounted to the automated guided vehicle 10 and the ground devices 20 are mounted to the floor 12. The power source 18 on the vehicle 10 provides a current to the electronics on the guided vehicle 10 permitting the guided vehicle, among other functions, to drive along the path 14 on the floor 12. In order to ground the negative terminal of the power source 18, a ground wire 28 is connected either to the frame of the vehicle 10 or directly to the grounding strap 16. The grounding strap 16 is suspended from the vehicle 10 a sufficient amount to permit the strap 16 to be in contact with the ground device 20.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A system for electrically grounding an automated guided vehicle comprising:

an automated guided vehicle operable to move along a predetermined path defined on a floor;

a grounding strap suspended from said automated guided vehicle;

at least one power source for providing power to said automated guided vehicle;

a ground wire extending from said power source to said grounding strap; and a plurality of ground devices mounted in said floor and each operable to contact said grounding strap during movement of said automated guided vehicle along said predetermined path to thereby electrically ground said automated guided vehicle, wherein said plurality of ground devices are fixed to said floor only along said path.

2. The system of claim 1, wherein at least one of said plurality of ground devices are formed as a rod.

3. The system of claim 1, wherein said plurality of grounding devices are spaced an equal predetermined distance from one another.

4. The system of claim 1, wherein at least one of said plurality of grounding devices is made of copper.

5. The system of claim 1, wherein at least one of said plurality of grounding devices include a reflector.

6. The system of claim 1, wherein said ground wire extends from said power source to a frame of said automated guided vehicle.

7. The system of claim 6, wherein said grounding strap is mounted to said frame.

8. A method for electrically grounding an automated guided vehicle comprising the steps of:

mounting an electrically conductive grounding strap to said automated guided vehicle;

connecting a negative wire of a power source of said automated guided vehicle to said ground strap, fixing a plurality of electrically conductive ground devices relative to a surface to be traversed by said automated guided vehicle;

positioning said grounding strap to be in contact with said ground device when said automated guided vehicle traverses said surface;

defining a path of travel for the automated guided vehicle relative to the surface; and arranging the plurality of ground devices only along the path of travel.

9. The method of claim 8 wherein said connecting step is further defined as:

connecting the negative wire of the power source of said automated guided vehicle directly to said ground strap.

10. The method of claim 8 wherein said mounting step is further defined as:

mounting the electrically conductive grounding strap to a trailing edge of said automated guided vehicle.

* * * * *

UNITED STATES PATENT AND TRADEMARK OFFICE

CERTIFICATE OF CORRECTION

PATENT NO. : 7,400,486 B2
APPLICATION NO. : 11/595583
DATED : July 15, 2008
INVENTOR(S) : Brian G. Stewart It is certified that error appears in the above-identified patent and that said Letters Patent is hereby corrected as shown below:

In The Specification:

Column 4, Line 47, should read as follows: -- mated guided vehicle to said ground strap; --

Signed and Sealed this

Eleventh Day of November, 2008

JON W. DUDAS
*Director of the United States Patent and Trademark Office*